US011247484B2

(12) United States Patent
Yabe et al.

(10) Patent No.: US 11,247,484 B2
(45) Date of Patent: Feb. 15, 2022

(54) THERMAL TRANSFER PRINTING APPARATUS, PRINTED PRODUCT MANUFACTURING METHOD, AND CARD SET

(71) Applicant: Dai Nippon Printing Co., Ltd., Tokyo (JP)

(72) Inventors: Suguru Yabe, Tokyo (JP); Yoshihiro Tahara, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 16/967,903

(22) PCT Filed: Apr. 23, 2019

(86) PCT No.: PCT/JP2019/017114
§ 371 (c)(1),
(2) Date: Aug. 6, 2020

(87) PCT Pub. No.: WO2019/208531
PCT Pub. Date: Oct. 31, 2019

(65) Prior Publication Data

US 2021/0023855 A1 Jan. 28, 2021

(30) Foreign Application Priority Data

Apr. 24, 2018 (JP) ..... JP2018-083185

(51) Int. Cl.
*B41J 3/407* (2006.01)
*B41J 2/325* (2006.01)
(Continued)

(52) U.S. Cl.
CPC ..... *B41J 2/315* (2013.01); *B41J 3/407* (2013.01); *B41J 3/60* (2013.01); *G09F 1/02* (2013.01); *G09F 23/00* (2013.01)

(58) Field of Classification Search
CPC ..... B41J 2/315; B41J 3/407; B41J 3/60; B41J 2/325; B41J 5/30; G09F 1/02; G09F 23/00
See application file for complete search history.

(56) References Cited

U.S. PATENT DOCUMENTS 6,283,188 B1 9/2001 Maynard et al.
2002/0127042 A1* 9/2002 Klinefelter ..... B41J 2/01 400/120.01
(Continued)

FOREIGN PATENT DOCUMENTS

JP 2002-143367 A1 5/2002
JP 2007-181992 A1 7/2007
JP 2017-177400 A1 10/2017

OTHER PUBLICATIONS

English translation of JP 2017-177400, published on Oct. 2017.*
(Continued)

*Primary Examiner* — Huan H Tran
(74) *Attorney, Agent, or Firm* — Burr & Brown, PLLC

(57) ABSTRACT

An image is formed on a principal surface and a side face of a card. A thermal transfer printing apparatus includes a first feeding unit configured to feed an intermediate transfer medium including a transfer layer that is disposed on one surface of a substrate in such a manner as to be peelable from the substrate, a second feeding unit configured to feed a thermal transfer sheet including a colorant layer disposed on one surface of a base material, a printing unit configured to heat the thermal transfer sheet based on image data and transfer an ink of the colorant layer onto the transfer layer to form an image, and a transfer unit configured to heat the intermediate transfer medium and transfer the transfer layer having the image formed thereon onto a principal surface and a side face of the card.

6 Claims, 9 Drawing Sheets

(51) Int. Cl.

| | |
|---|---|
| ***B41J 2/315*** | (2006.01) |
| ***B41J 3/60*** | (2006.01) |
| ***G09F 1/02*** | (2006.01) |
| ***G09F 23/00*** | (2006.01) |

(56) References Cited

U.S. PATENT DOCUMENTS

| | | | |
|---|---|---|---|
| 2005/0248088 | A1 | 11/2005 | Yoshida et al. |
| 2007/0099462 | A1 | 5/2007 | Helma et al. |
| 2015/0035932 | A1 | 2/2015 | Aihara et al. |

OTHER PUBLICATIONS

English translation of JP 2007-181992, published on Jul. 2007.*
International Search Report and Written Opinion (Application No. PCT/JP2019/017114) dated May 28, 2019.
European Search Report, European Application No. 19791995.4, dated Sep. 21, 2021 (9 pages).

* cited by examiner

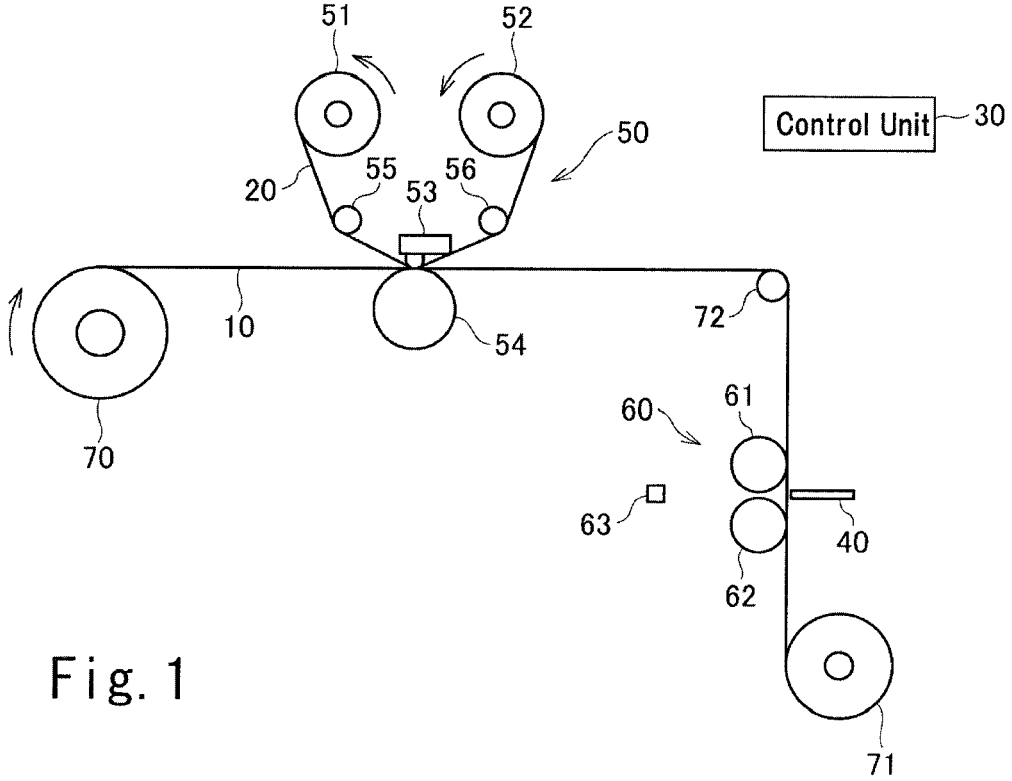
Fig. 1
Fig. 2
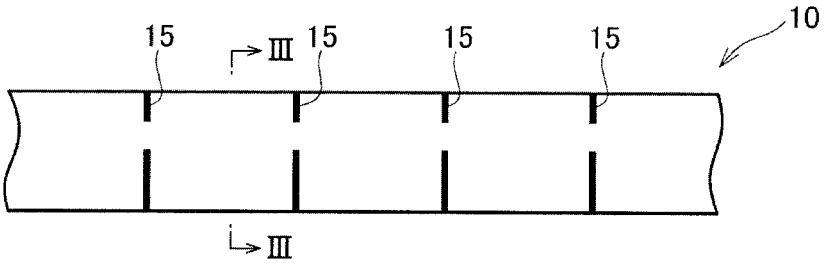
Fig. 3
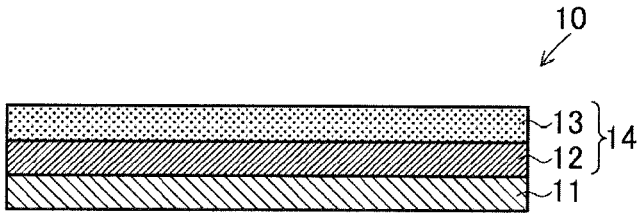

Fig. 6a
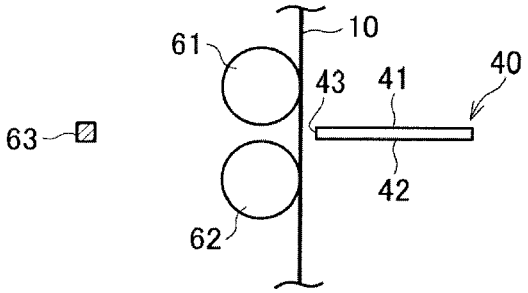
Fig. 6b
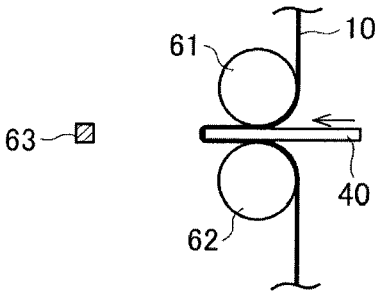
Fig. 6c
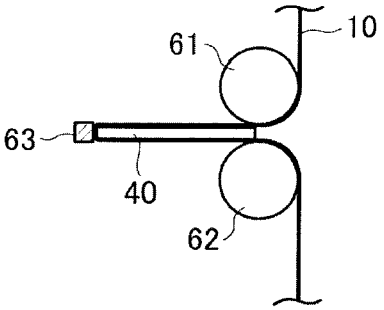
Fig. 6d
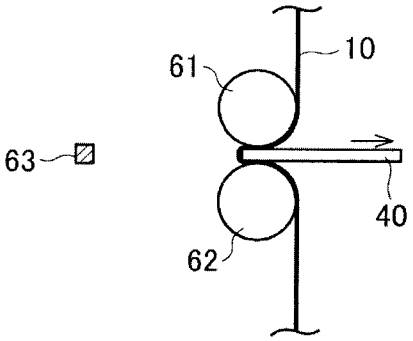
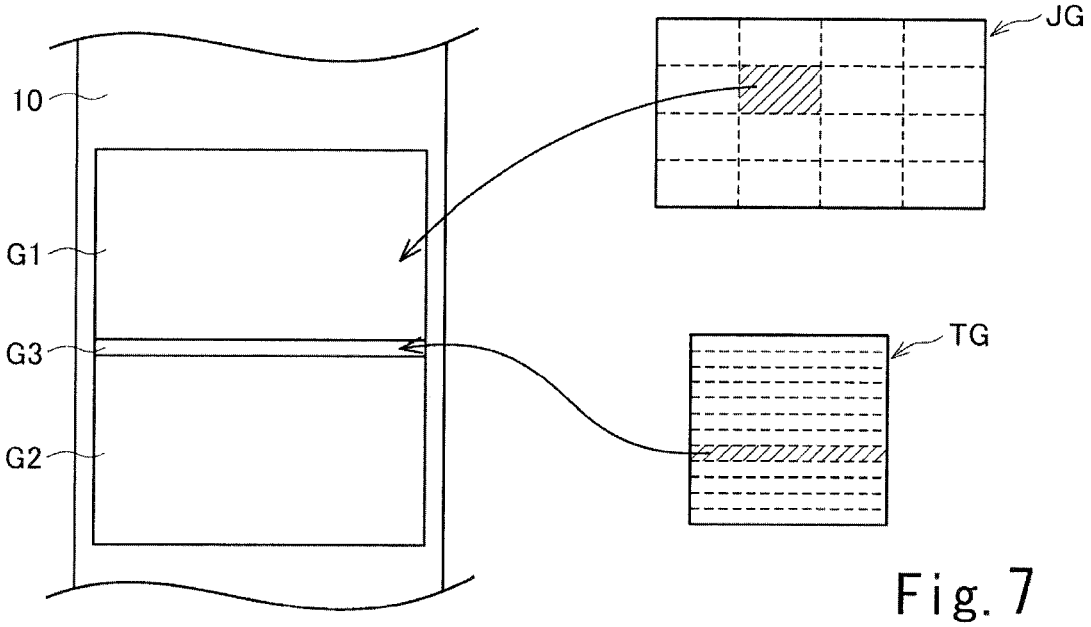
Fig. 7

Fig. 8
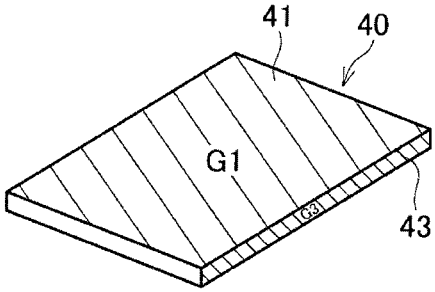
Fig. 9
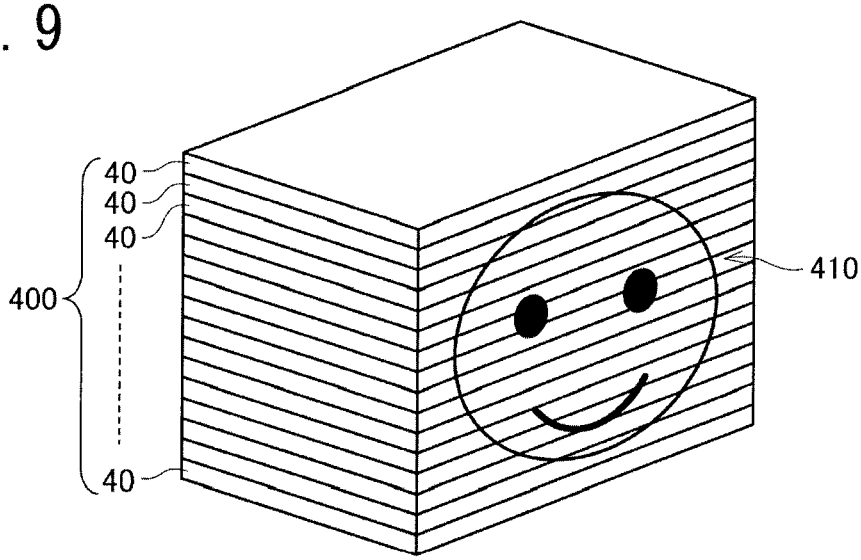
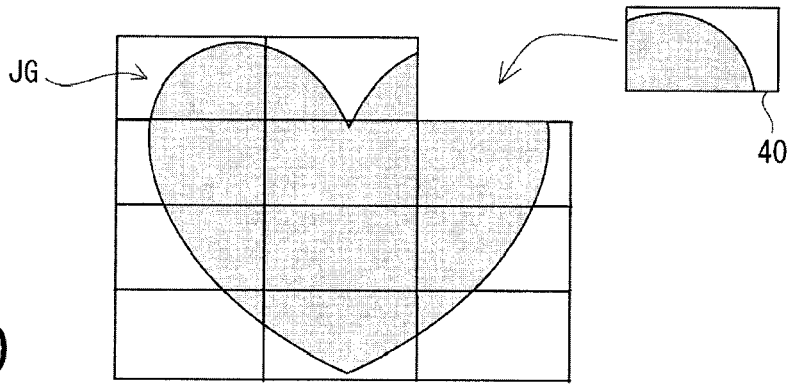
Fig. 10

THERMAL TRANSFER PRINTING APPARATUS, PRINTED PRODUCT MANUFACTURING METHOD, AND CARD SET

TECHNICAL FIELD

The present invention relates to a thermal transfer printing apparatus, a printed product manufacturing method, and a card set.

BACKGROUND ART

As a printer that forms a thermal transfer image on any object, a thermal transfer printer has been proposed, which uses an intermediate transfer medium including a receiving layer separably disposed on a base material and a thermal transfer sheet including a colorant layer. After transferring ink onto the receiving layer of the intermediate transfer medium to form an image, the thermal transfer printer transfers, from the intermediate transfer medium onto a transfer target, a transfer layer including the receiving layer having the image formed thereon.

A card printer is also known, which is configured to simultaneously attach films having images formed thereon to both sides of a card.

Printed products, such as cards each having an image formed on either one or both sides thereof, have been produced conventionally in the above-described manner. There is demand for producing more unique printed products using thermal transfer printers.

Patent Literature 1: Japanese Unexamined Patent Application Publication No. 2002-143367

Patent Literature 2: Japanese Unexamined Patent Application Publication No. 2017-177400

Patent Literature 3: U.S. Pat. No. 6,283,188

SUMMARY OF INVENTION

The present invention aims to provide a thermal transfer printing apparatus and a printed product manufacturing method by which an image can be formed not only on a principal surface of a card, but also on a side face of the card. The present invention also aims to provide a card set in which an image appears on a side face of a card stack.

According to the present invention, a thermal transfer printing apparatus includes a first feeding unit feeding an intermediate transfer medium including a transfer layer that is disposed on one surface of a substrate in such a manner as to be peelable from the substrate, a second feeding unit feeding a thermal transfer sheet including a colorant layer disposed on one surface of a base material, a printing unit heating the thermal transfer sheet based on image data and transferring an ink of the colorant layer onto the transfer layer to form an image, and a transfer unit heating the intermediate transfer medium and transferring the transfer layer having the image formed thereon onto a principal surface and a side face of a card.

According to one aspect of the present invention, the transfer unit includes a first heat roller and a second heat roller and transfers the transfer layer onto a first principal surface and a second principal surface of the card, with the intermediate transfer medium being sandwiched between the first principal surface and the first heat roller and between the second principal surface and the second heat roller.

According to one aspect of the present invention, the transfer unit includes a pressing member transferring the transfer layer onto the side face of the card, with the intermediate transfer medium being sandwiched between the pressing member and the side face of the card.

According to one aspect of the present invention, the pressing member is a heater.

According to one aspect of the present invention, a contact face of the pressing member is flat, the contact face coming into contact with the side face of the card, with the intermediate transfer medium being sandwiched therebetween.

According to one aspect of the present invention, a contact face of the pressing member has a recess into which an end portion of the card is to be inserted, the contact face coming into contact with the side face of the card, with the intermediate transfer medium being sandwiched therebetween.

According to one aspect of the present invention, the printing unit forms a first image for the principal surface and a second image for the side face, respectively, on the transfer layer, and the second image is one of sub-images obtained by dividing one image into stripes.

According to one aspect of the present invention, the first image is one of sub-images obtained by dividing one image into checkers.

According to the present invention, a printed product manufacturing method includes feeding an intermediate transfer medium including a transfer layer that is disposed on one surface of a substrate in such a manner as to be peelable from the substrate, feeding a thermal transfer sheet including a colorant layer disposed on one surface of a base material, heating the thermal transfer sheet based on image data and transferring an ink of the colorant layer onto the transfer layer to form an image, and heating the intermediate transfer medium and transferring the transfer layer having the image formed thereon onto a principal surface and a side face of a card to manufacture a printed product.

According to the present invention, a card set includes a plurality of cards, wherein a side face of each of the cards has a sub-image printed thereon, the sub-image being one of sub-images obtained by dividing an image into stripes, and the image appears on a side face of a stack of the cards.

According to one aspect of the present invention, a principal surface of each of the cards has a sub-image printed thereon, the sub-image being one of sub-images into which one image is divided.

Advantageous Effects of Invention

The present invention makes it possible to form an image not only on a principle surface of a card, but also on a side face of the card. By stacking a plurality of cards, an image can appear on a side face of the resulting stack.

BRIEF DESCRIPTION OF DRAWINGS

FIG. 1 is a schematic diagram of a thermal transfer printing apparatus according to an embodiment of the present invention.

FIG. 2 is a plan view of an intermediate transfer medium.

FIG. 3 is a cross-sectional view taken along line III-III in FIG. 2.

FIGS. 6*a* to 6*d* are diagrams illustrating how a transfer layer is transferred.

FIG. 7 is a diagram illustrating an example of images printed on the intermediate transfer medium.

FIG. 8 is a perspective view of a card having images formed thereon.

FIG. 9 is a perspective view of a card stack.

FIG. 10 illustrates an example where cards are arranged to reproduce an image.

DESCRIPTION OF EMBODIMENTS

Figure 4:
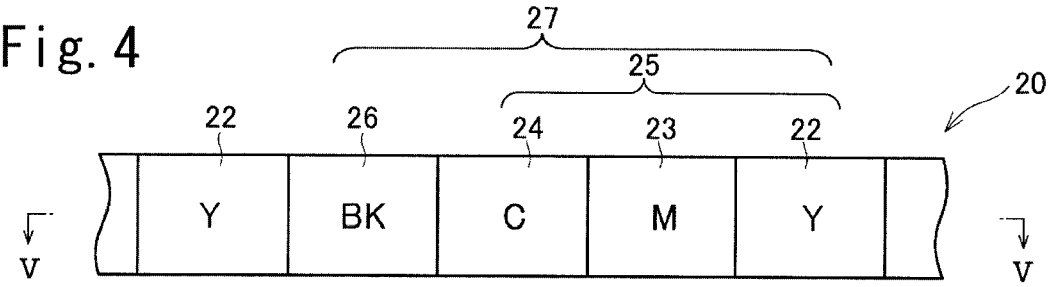
FIG. 4 is a plan view of a thermal transfer sheet.

Embodiments of the present invention will now be described on the basis of the drawings.

FIG. 1 is a schematic diagram of a thermal transfer printing apparatus according to an embodiment of the present invention. As illustrated in FIG. 1, the thermal transfer printing apparatus includes a printing unit 50 that prints an image on a receiving layer 13 (see FIG. 3) of an intermediate transfer medium 10 using a thermal transfer sheet 20, a transfer unit 60 that transfers a transfer layer 14 (see FIG. 3) of the intermediate transfer medium 10 onto a card 40 (or transfer target), and a control unit 30 that controls the operation of each part.

FIG. 2 is a plan view of the intermediate transfer medium 10, and FIG. 3 is a cross-sectional view taken along line III-III in FIG. 2. The intermediate transfer medium 10 includes a substrate 11 and the transfer layer 14 disposed on one surface of the substrate 11. The transfer layer 14 has a multilayer structure that includes a separation layer 12 disposed on the substrate 11 and the receiving layer 13 disposed on the separation layer 12. The receiving layer 13 is on the front side of the intermediate transfer medium 10. That is, of the layers included in the transfer layer 14, the receiving layer 13 is located farthest from the substrate 11.

The intermediate transfer medium 10 has detection marks 15 formed thereon at regular intervals. Each of regions between adjacent ones of the detection marks 15 is an image formation region to be transferred onto one card 40. Ink is thermally transferred onto the receiving layer 13 to form an image. The transfer layer 14 having the image formed thereon is transferred onto the card 40.

As described below, in the present embodiment, an image is transferred onto both surfaces (principal surfaces 41 and 42, see FIG. 6*a*) and a side face of the card 40. This means that each region between adjacent ones of the detection marks 15 is more than twice as large as the principal surface 41 of the card 40. The detection marks 15 may be printed as images are being formed on the receiving layer 13.

(Thermal Transfer Sheet)

Figure 5:
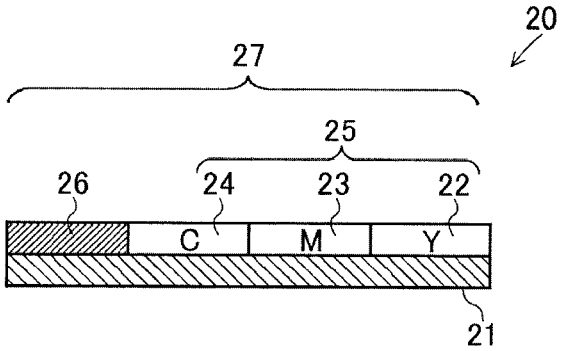
FIG. 5 is a cross-sectional view taken along line V-V in FIG. 4.

FIG. 4 is a plan view of the thermal transfer sheet 20, and FIG. 5 is a cross-sectional view taken along line V-V in FIG. 4. As illustrated in FIG. 4 and FIG. 5, the thermal transfer sheet 20 includes a base material 21, a dye layer 25, and a fusion layer 26. A yellow (Y) layer 22, a magenta (M) layer 23, and a cyan (C) layer 24 included in the dye layer 25 and the fusion layer 26 of black (BK) are arranged on the same surface of the base material 21. Colorant layers 27, each including a set of the dye layer 25 and the fusion layer 26, are arranged in a repeated manner. At least one of the layers included in each colorant layer 27 may be more than twice as large as the principal surface 41 of the card 40.

The base material 21 is not limited to a specific one. For example, a sheet of thin paper or a stretched or unstretched plastic film may be used as the base material 21.

The dye layer 25 contains dyes and a binder resin for bearing the dyes. Any dyes and any binder resin conventionally known in the field of dye-sublimation thermal transfer sheets may be appropriately selected and used.

The fusion layer 26 may be any layer that is capable of being fused and softened by heat and transferred onto the transfer layer 14. The fusion layer 26 contains, for example, a thermofusible ink and a binder resin. The fusion layer 26 is optional.

The configuration of the thermal transfer sheet 20 is not limited to that illustrated in FIG. 4 and FIG. 5. For example, a backside layer (not shown) may be added to the surface of the thermal transfer sheet 20 opposite the colorant layer.

(Thermal Transfer Printing Apparatus)

As illustrated in FIG. 1, the intermediate transfer medium 10, which is wound like a ribbon into a roll, is loaded in a feeding unit 70 (first feeding unit) of the thermal transfer printing apparatus. The feeding unit 70 rotates the roll of the intermediate transfer medium 10 and conveys the intermediate transfer medium 10, which is in a long belt-like shape, to the printing unit 50 then to the transfer unit 60.

The printing unit 50 includes a thermal head 53, a platen roll 54 disposed below the thermal head 53 and capable of being driven to rotate, and a raising and lowering means (not shown) capable of raising and lowering the thermal head 53 with respect to the platen roll 54. The intermediate transfer medium 10 fed by the feeding unit 70 is routed to pass between the thermal head 53 and the platen roll 54.

In the printing unit 50, the thermal transfer sheet 20 fed by a feeding roll 51 (second feeding unit) is routed through a guide roll 55, conveyed between the thermal head 53 and the platen roll 54, further routed through the guide roll 56, and wound by a winding roll 52. At the point between the thermal head 53 and the platen roll 54, the dye layer 25 and the fusion layer 26 of the thermal transfer sheet 20 face the receiving layer 13 of the intermediate transfer medium 10.

The thermal head 53 is configured to heat the dye layer 25 of the thermal transfer sheet 20, with the base material 21 interposed therebetween, so as to transfer the dyes onto the receiving layer 13 of the intermediate transfer medium 10 to form an image. Also, the thermal head 53 is configured to heat the fusion layer 26 of the thermal transfer sheet 20, with the base material 21 interposed therebetween, so as to transfer, for example, a thermofusible ink onto the receiving layer 13 of the intermediate transfer medium 10 to form an image (or text).

In the step of forming an image, first, the intermediate transfer medium 10 is aligned with the Y layer 22 of the thermal transfer sheet 20. Then, the thermal head 53 is lowered toward and brought into contact with the platen roll 54, with the thermal transfer sheet 20 and the intermediate transfer medium 10 interposed therebetween. The platen roll 54 is driven to rotate to convey the thermal transfer sheet 20 and the intermediate transfer medium 10. On the basis of image data transmitted to the thermal head 53 during this operation, the thermal head 53 selectively heats some regions of the Y layer 22 of the thermal transfer sheet 20 to transfer a yellow dye from the thermal transfer sheet 20 onto the receiving layer 13.

After transfer of the yellow dye, the thermal head 53 rises to separate from the platen roll 54. Next, the intermediate transfer medium 10 is aligned with the M layer 23 of the thermal transfer sheet 20. Then, similarly to the method of transferring the yellow dye onto the receiving layer 13, the M layer 23 and the C layer 24 are heated to sequentially transfer a magenta dye and a cyan dye onto the receiving layer 13.

The thermal head 53 then rises to separate from the platen roll 54. Next, the intermediate transfer medium 10 is aligned with the fusion layer 26 of the thermal transfer sheet 20. The thermal head 53 is lowered toward and brought into contact with the platen roll 54, with the thermal transfer sheet 20 and the intermediate transfer medium 10 interposed therebetween. The platen roll 54 is driven to rotate to convey the thermal transfer sheet 20 and the intermediate transfer medium 10. On the basis of image data transmitted to the thermal head 53 during this operation, the thermal head 53 selectively heats some regions of the fusion layer 26 of the thermal transfer sheet 20. An image is thus formed on the intermediate transfer medium 10.

The intermediate transfer medium 10 having an image formed on the receiving layer 13 by the printing unit 50, is conveyed through a guide roll 72 to the transfer unit 60.

The transfer unit 60 includes two heat rollers 61 and 62 and a heater 63. The transfer unit 60 transfers the transfer layer 14 of the intermediate transfer medium 10 onto the card 40 fed by a transfer target feeder (not shown).

The card 40 is, for example, substantially rectangular in shape and contains a synthetic resin as a base material. Examples of the synthetic resin include polyvinyl chloride, polyester, polycarbonate, polyamide, polyimide, polycellulose diacetate, polycellulose triacetate, polystyrene, acrylic resin, polypropylene, and polyethylene. The card 40 has two principal surfaces 41 and 42 opposite each other and four side faces (see FIG. 6 and FIG. 8). The transfer unit 60 transfers the transfer layer 14 onto the two principal surfaces 41 and 42 and a side face 43 (one of the four side faces) of the card 40.

The card 40 is conveyed to the transfer unit 60, with a pair of sides of the card 40 being parallel to the short side of the intermediate transfer medium 10 and with the principal surfaces 41 and 42 of the card 40 being perpendicular to the intermediate transfer medium 10.

In the transfer unit 60, as illustrated in FIGS. 6*a* and 6*b*, the intermediate transfer medium 10 and the card 40 are drawn in between the heat roller 61 and the heat roller 62 and heated, with the receiving layer 13 of the intermediate transfer medium 10 having an image thereon being placed over the card 40. The heat roller 61 heats the intermediate transfer medium 10 sandwiched between the principal surface 41 of the card 40 and the heat roller 61. Similarly, the heat roller 62 heats the intermediate transfer medium 10 sandwiched between the principal surface 42 of the card 40 and the heat roller 62. This enables the transfer layer 14 to be separated from the substrate 11 and transferred onto the principal surfaces 41 and 42 of the card 40 at the same time. An image is thus formed on each of the principal surfaces 41 and 42.

As illustrated in FIG. 6*c*, the heater 63 is disposed on the line extending in the direction in which the card 40 is drawn. The heater 63 carries out heating, with the receiving layer 13 of the intermediate transfer medium 10 placed on the side face 43 of the card 40. The heater 63 heats the intermediate transfer medium 10 sandwiched between the side face 43 of the card 40 and the heater 63. This enables the transfer layer 14 to be separated from the substrate 11 and transferred onto the side face 43 of the card 40, so that an image is formed on the side face 43. The heater 63 may be replaced by a plate-like pressing member with no heating mechanism. In this case, the intermediate transfer medium 10 is sandwiched between the side face 43 of the card 40 and the pressing member, so as to transfer the transfer layer 14 onto the side face 43 of the card 40.

Then, the card 40 is pulled back, as illustrated in FIG. 6*d*. After the transfer layer 14 is transferred onto the principal surfaces 41 and 42 and the side face 43, the card 40 is conveyed to and stored in an accumulating unit (not shown). After the transfer layer 14 is transferred, the intermediate transfer medium 10 is wound by a collecting unit 71.

FIG. 7 is a diagram illustrating an example of images printed on the intermediate transfer medium 10 by the printing unit 50. The printing unit 50 performs a printing operation such that an image G1 to be formed on the principal surface 41, an image G3 to be formed on the side face 43, and an image G2 to be formed on the principal surface 42 are arranged in this order. For example, the image G1 is one of sub-images obtained by dividing an image JG into checkers (in a mesh form). Dividing into checkers means, for example, to divide along a plurality of straight lines orthogonal to each other.

The image G3 is one of sub-images obtained by dividing an image TG into stripes. By dividing one image into stripes, a plurality of long narrow sub-images are arranged in parallel in one direction.

For example, when data and the number of sub-images of each of the image JG and the image TG are input to the thermal transfer printing apparatus, the control unit 30 divides the image JG into the input number of sub-images into checkers (in a mesh form), and divides the image TG into the input number of stripe-shaped sub-images. The control unit 30 sequentially transfers data of the sub-images to the printing unit 50 and controls the printing operation.

After the image G3 on the intermediate transfer medium 10 is positioned to face the side face 43 of the card 40, the card 40 is drawn in by the transfer unit 60 as illustrated in FIG. 6*b*. This allows a portion of the transfer layer 14 corresponding to the image G1 to be transferred onto the principal surface 41 of the card 40, and allows another portion of the transfer layer 14 corresponding to the image G2 to be transferred onto the principal surface 42 on the opposite side.

After the transfer layer 14 is transferred, as illustrated in FIG. 8, the image G1 and the image G3 are formed on the principal surface 41 and the side face 43, respectively, of the card 40 and the image G2 is formed on the principal surface 42 of the card 40 (not shown).

In the next printing operation, the printing unit 50 prints other sub-images, as the images G1 and G3, on the intermediate transfer medium 10. For example, sub-images adjacent to those previously printed are printed on the intermediate transfer medium 10.

The image G2 to be formed on the principal surface 42 may vary from one card 40 to another, or may be the same.

When a plurality of cards 40, each having the image G3 formed on the side face 43, are stacked in a predetermined order, an image (image TG) appears, as illustrated in FIG. 9, on a side face 410 of a card stack 400.

As described above, the present embodiment makes it possible to form an image not only on the principal surface 41 (42) of the card 40, but also on the side face 43 of the card 40. Additionally, by stacking a plurality of cards 40, an image can appear on the side face 410 of the card stack 400. The absence of any card can be identified by detecting discontinuity in the resulting picture on the side face 410.

When sub-images obtained by dividing the image JG into checkers (in a mesh form) are formed on the respective principal surfaces 41 of the cards 40, the image JG can be reproduced and enjoyed by arranging a plurality of cards 40, as illustrated in FIG. 10, in a jigsaw puzzle-like manner. The absence of any card can be identified by detecting discontinuity in the reproduced image JG.

In the embodiments described above, the images formed on the principal surfaces 41 and 42 and side face 43 of the card 40 are not limited to specific ones. The images formed on the principal surface 41 and the side face 43 each do not need to be a sub-image obtained by dividing the original image, and may vary from one card 40 to another or may be the same.

In the embodiments described above, the two principal surfaces 41 and 42 of each card 40 have the images G1 and G2, respectively, formed thereon. However, the principal surface 42 does not necessarily need to have an image formed thereon. In this case, the heat roller 62 may be replaced by a pressure roll with no heating capability.

Figure 11A:
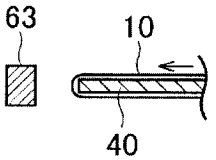
FIGS. 11*a* to 11*d* are diagrams each illustrating an exemplary configuration of a heater.
Figure 11B:
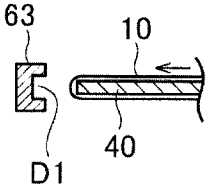
Figure 11C:
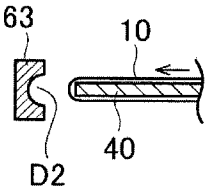

The heating face (contact face) of the heater 63 that heats the side face 43 of the card 40 may be flat, as illustrated in FIG. 11*a*. For improved adhesion to the card 40, the heating face may have a recess D1 rectangular in cross-section, as illustrated in FIG. 11*b*, or may have a recess D2 semicircular in cross-section, as illustrated in FIG. 11*c*. The end portion of the card 40 is inserted into the recess D1 or D2.

Figure 11D:
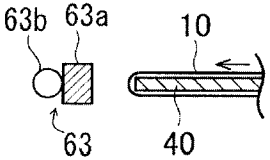

As illustrated in FIG. 11*d*, the heater 63 may include a contact portion 63*a* that comes into contact with the side face of the card 40, with the intermediate transfer medium 10 interposed therebetween, and a heating portion 63*b* that applies heat to the contact portion 63*a*.

Figure 12A:
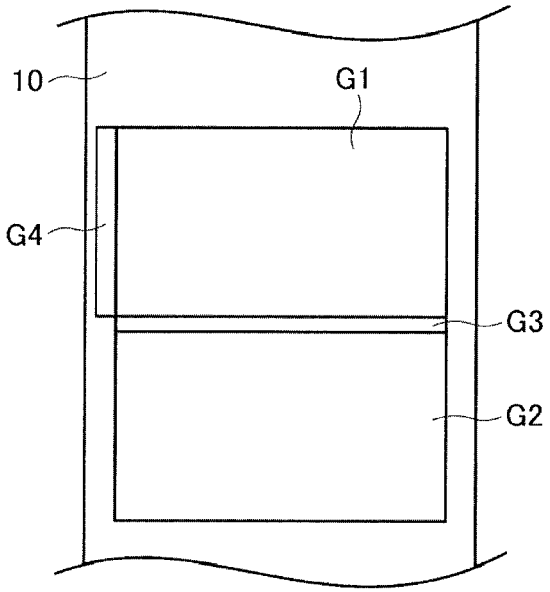
FIG. 12*a* is a diagram illustrating an example of images printed on the intermediate transfer medium.
Figure 12B:
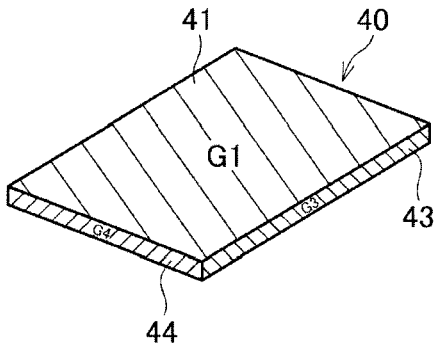
FIG. 12*b* is a perspective view of a card having images formed thereon.
Figure 15:
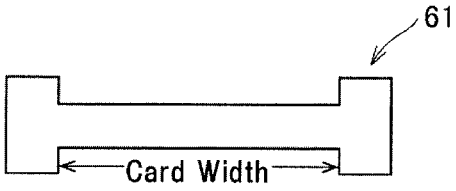
FIG. 15 is a schematic diagram of an exemplary modified heat roller.

An image may be formed on more than one of the four side faces of the card 40. For example, as illustrated in FIG. 12*a*, an image G4 is formed next to the image G1. By drawing in the intermediate transfer medium 10 and the card 40 between the heat rollers 61 and 62 while heating the intermediate transfer medium 10 and the card 40, the image G1 and the image G4 can be formed on the principal surface 41 and a side face 44, respectively, as illustrated in FIG. 12*b*. For example, by using a roller with steps as the heat roller 61, as illustrated in FIG. 15, the image G4 can be formed on the side face 44 while the image G1 is being formed on the principal surface 41.

Figure 16:
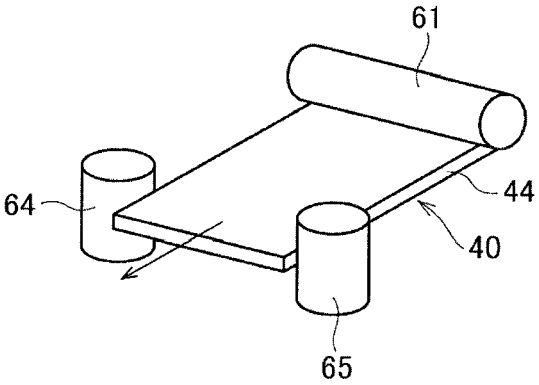
FIG. 16 is a schematic diagram of heat rollers for transfer to side faces.
Figure 17:
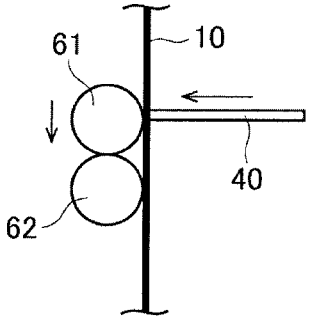
FIG. 17 is a diagram illustrating an example of how an image is formed on a side face of a card.

As illustrated in FIG. 16, heat rollers 64 and 65 for transfer to side faces may be provided.

Figure 12C:
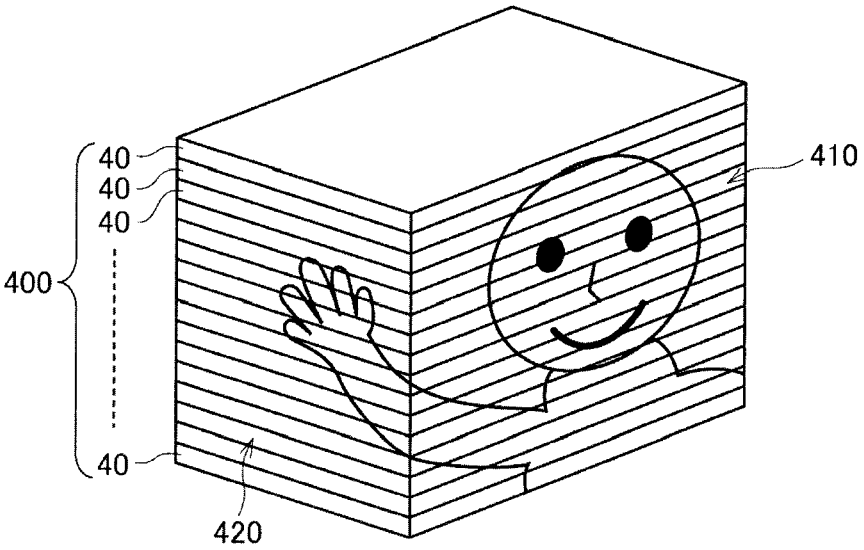
FIG. 12*c* is a perspective view of a card stack.

When a plurality of cards 40, each having the images G3 and G4 formed on the side faces 43 and 44, are stacked in a predetermined order, an image appears on side faces 410 and 420 of the card stack 400 as illustrated in FIG. 12*c*. For example, one image can be expressed in an area extending over both the side face 410 and the side face 420.

After image formation on the principal surfaces 41 and 42 and the side face 43, the card 40 may be drawn back, rotated 90 degrees in a plane horizontal to the principal surfaces, and drawn in again to form an image on the side face 44. To prevent the images formed on the principal surfaces 41 and 42 from being affected, it is preferable at this point to control the temperature of the heat rollers 61 and 62. The principal surfaces 41 and 42 may be covered with a thermal insulating member.

(Intermediate Transfer Medium)

As described above, the intermediate transfer medium 10 includes the substrate 11, the separation layer 12, and the receiving layer 13 that are stacked. The material for the substrate 11 is not limited to a specific one. For example, the substrate 11 may be a stretched or unstretched film of highly heat-resistant polyester such as polyethylene terephthalate or polyethylene naphthalate, or of plastic such as polypropylene, polycarbonate, cellulose acetate, polyethylene derivative, polyamide, or polymethylpentene. A composite film formed by stacking layers of two or more types of these materials may also be used as the substrate 11. The thickness of the substrate 11 may be appropriately selected in accordance with the material so as to ensure, for example, proper strength and thermal resistance. The thickness of the substrate 11 typically ranges from 3 μm to 30 μm, and preferably ranges from 4 μm to 20 μm.

The material for the receiving layer 13 is not limited to a specific one, and any receiving layer conventionally known in the field of intermediate transfer media may be appropriately selected and used. The material for the receiving layer 13 may be, for example, polyolefin such as polypropylene, halogenated resin such as polyvinyl chloride or polyvinylidene chloride, vinyl resin such as polyvinyl acetate, vinyl chloride-vinyl acetate copolymer, ethylene-vinyl acetate copolymer, or polyacrylic acid ester, polyester such as polyethylene terephthalate or polybutylene terephthalate, copolymer of olefin such as polystyrene, polyamide, ethylene, or propylene and another vinyl polymer, cellulosic resin such as ionomer or polycellulose diastase, or solvent-based resin such as polycarbonate or acrylic resin. The receiving layer 13 may contain only one of these components, or may contain two or more of these components.

The receiving layer 13 may contain a release agent, as well as the resin component described above. Examples of the release agent include polyethylene wax, amide wax, solid waxes such as Teflon (registered trademark) powders, fluorochemical or phosphoester surfactant, silicone oil, various types of modified silicone oils such as reactive silicone oil and curable silicone oil, and various types of silicone resins.

The thickness of the receiving layer 13 is not limited to a specific value. For example, the thickness of the receiving layer 13 ranges from 1 μm to 10 μm.

The separation layer 12 is provided to improve transfer performance (separation performance) of the transfer layer 14. Of the layers included in the transfer layer 14, the separation layer 12 is located closest to the substrate 11. Exemplary components of the separation layer 12 include waxes, silicone wax, silicone resin, silicone-modified resin, fluorocarbon resin, fluorine-modified resin, polyvinyl alcohol, acrylic resin, thermal cross-linking epoxy-amino resin, and thermal cross-linking alkyd-amino resin. The separation layer 12 may contain only one of these components, or may contain two or more of these components.

The thickness of the separation layer 12 is not limited to a specific value. For example, the thickness of the separation layer 12 ranges from 0.5 μm to 5 μm.

The configuration of the intermediate transfer medium 10 is not limited to that illustrated in FIG. 3. For example, any layer, such as a protective layer (not shown), may be added between the separation layer 12 and the receiving layer 13. The protective layer and the receiving layer 13 may be stacked in this order on the substrate 11 to form the transfer layer 14. Any layer may be added between the substrate 11 and the transfer layer 14. A backside layer (not shown) may be added onto the surface opposite the substrate 11.

Thermal Transfer Printing Apparatus According to Another Embodiment

Figure 13:
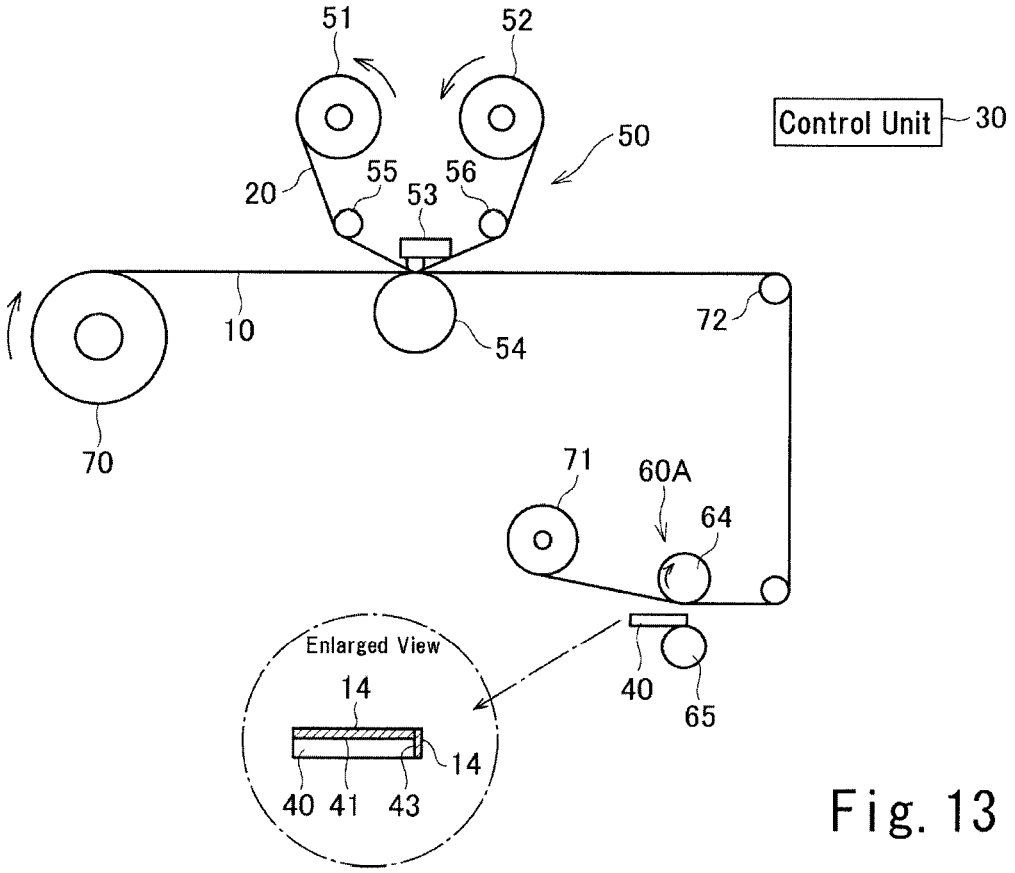
FIG. 13 is a schematic diagram of a thermal transfer printing apparatus according to another embodiment.

The thermal transfer printing apparatus that forms an image on a principal surface and a side face of a card is not limited to that illustrated in FIG. 1. For example, as illustrated in FIG. 13, with the intermediate transfer medium 10 and the card 40 being sandwiched between the heat roller 64 and the platen roller 65 of a transfer unit 60A, the heat roller 64 is rotated while being heated to transfer the transfer layer 14 of the intermediate transfer medium 10 onto the principal surface 41 of the card 40. Then, when the trailing end of the card 40 in the conveyance direction reaches the heat roller 64, the rotation of the heat roller 64 is temporarily stopped. The transfer layer 14 of the intermediate transfer medium 10 is thus transferred onto the side face 43 of the card 40 (see the enlarged view in FIG. 13).

Figure 14A:
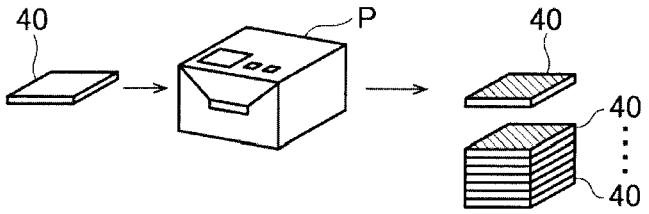
FIGS. 14*a* to 14*e* are diagrams illustrating a thermal transfer printing method according to another embodiment.
Figure 14B:
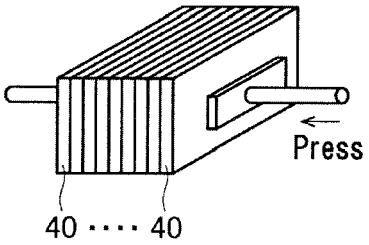

After image formation on the principal surface of each of cards 40, the cards 40 may be stacked to form an image on the side face of the card stack. For example, as illustrated in FIG. 14*a*, a printer P forms an image on the principal surface of each of the cards 40. Next, as illustrated in FIG. 14*b*, the cards 40 each having an image formed on the principal surface thereof are stacked and pressed together.

Figure 14C:
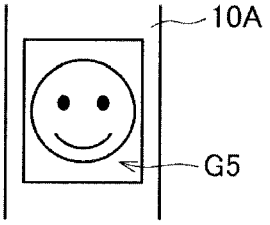
Figure 14D:
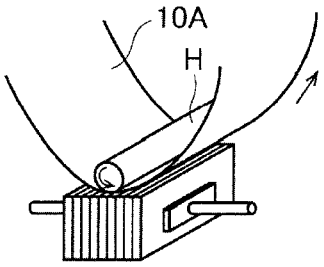
Figure 14E:
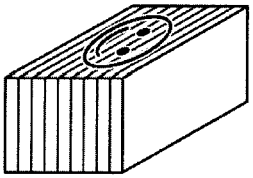

As illustrated in FIG. 14*c*, an image G5 for a side face of the card stack is formed on a transfer layer of an intermediate transfer medium 10A. Then, as illustrated in FIG. 14*d*, the transfer layer of the intermediate transfer medium 10A is transferred onto the side face of the card stack using a heat roller H. Thus, as illustrated in FIG. 14*e*, an image is formed on the side face of the card stack. The heat rollers 61 and 62 or the card 40 may be turned upside down to form the image G3 on the side face 43 by bringing the heat rollers 61 and 62 into contact with the end portion of the card 40. The heater 63 is optional in this case.

It should be noted that the present invention is not limited to the above-described embodiments as they are, and can be embodied by modifying the constituent elements within a range not departing from the gist of the invention in an implementation stage. Further, various inventions can be formed by appropriately combining a plurality of constituent elements disclosed in the above embodiments. For example, some components may be deleted from all the components shown in the embodiment. Furthermore, the constituent elements of different embodiments may be combined appropriately.

The present invention has been described in details using specific embodiments; however, it is obvious to those skilled in the art that various changes can be made without departing from the gist and scope of the present invention.

This application is based on Japanese Patent Application No. 2018-083185 filed on Apr. 24, 2018, which is hereby incorporated by reference herein in its entirety.

REFERENCE SIGNS LIST

10: intermediate transfer medium
11: support member
12: separation layer
13: receiving layer
14: transfer layer
15: detection mark
20: thermal transfer sheet
21: base material
22: yellow layer
23: magenta layer
24: cyan layer
25: dye layer
26: fusion layer
27: colorant layer
40: card
41, 42: principal surface
43: side face
50: printing unit
60: transfer unit
61, 62: heat roller
63: heater

The invention claimed is:

1. A thermal transfer printing apparatus comprising:

a first feeding unit feeding an intermediate transfer medium including a transfer layer that is disposed on one surface of a substrate in such a manner as to be peelable from the substrate;

a second feeding unit feeding a thermal transfer sheet including a colorant layer disposed on one surface of a base material;

a printing unit heating the thermal transfer sheet based on image data and transferring an ink of the colorant layer onto the transfer layer to form an image; and a transfer unit heating the intermediate transfer medium and transferring the transfer layer having the image formed thereon onto a principal surface and a side face of a card, wherein the transfer unit includes pressing member transferring the transfer layer onto the side face of the card, with the intermediate transfer medium being sandwiched between the pressing member and the side face of the card, and wherein a contact face of the pressing member is flat, the contact face coming into contact with the side face of the card, with the intermediate transfer medium being sandwiched therebetween.

2. A thermal transfer printing apparatus comprising:

a first feeding unit feeding an intermediate transfer medium including a transfer layer that is disposed on one surface of a substrate in such a manner as to be peelable from the substrate;

a second feeding unit feeding a thermal transfer sheet including a colorant layer disposed on one surface of a base material;

a printing unit heating the thermal transfer sheet based on image data and transferring an ink of the colorant layer onto the transfer layer to form an image; and a transfer unit heating the intermediate transfer medium and transferring the transfer layer having the image formed thereon onto a principal surface and a side face of a card, wherein the transfer unit includes pressing member transferring the transfer layer onto the side face of the card, with the intermediate transfer medium being sandwiched between the pressing member and the side face of the card, and wherein a contact face of the pressing member has a recess into which an end portion of the card is to be inserted, the contact face coming into contact with the side face of the card, with the intermediate transfer medium being sandwiched therebetween.

3. A thermal transfer printing apparatus comprising:

a first feeding unit feeding an intermediate transfer medium including a transfer layer that is disposed on one surface of a substrate in such a manner as to be peelable from the substrate;

a second feeding unit feeding a thermal transfer sheet including a colorant layer disposed on one surface of a base material;

a printing unit heating the thermal transfer sheet based on image data and transferring an ink of the colorant layer onto the transfer layer to form an image; and a transfer unit heating the intermediate transfer medium and transferring the transfer layer having the image formed thereon onto a principal surface and a side face of a card, wherein the printing unit forms a first image for the principal surface and a second image for the side face, respectively, on the transfer layer; and the second image is one of sub-images obtained by dividing one image into stripes.

4. The thermal transfer printing apparatus according to claim 3, wherein the first image is one of sub-images obtained by dividing one image into checkers.

5. A card set comprising a plurality of cards, wherein a side face of each of the cards has a sub-image printed thereon, the sub-image being one of sub-images obtained by dividing an image into stripes; and the image appears on a side face of a stack of the cards.

6. The card set according to claim 5, wherein a principal surface of each of the cards has a sub-image printed thereon, the sub-image being one of sub-images into which one image is divided.

* * * * *